United States Patent [19]

Matsumoto et al.

[11] Patent Number: 4,915,296

[45] Date of Patent: Apr. 10, 1990

[54] HOT WATER CIRCULATING SYSTEM

[75] Inventors: Motoki Matsumoto; Kouichi Watanabe, both of Aichi, Japan

[73] Assignee: Toyotomi Kogyo Co., Ltd., Japan

[21] Appl. No.: 150,110

[22] Filed: Jan. 29, 1988

[51] Int. Cl.[4] ..... F24D 3/00

[52] U.S. Cl. ..... 237/8 R; 237/60

[58] Field of Search ..... 237/8 R, 60, 59, 19, 237/56

[56] References Cited

FOREIGN PATENT DOCUMENTS 23731 2/1982 Japan .
53929 11/1982 Japan .

*Primary Examiner*—Henry A. Bennet
*Attorney, Agent, or Firm*—Pollock, Vande Sande & Priddy

[57] ABSTRACT

A hot water circulating system capable of increasing the amount of hot water to be circulated in each circulating cycle, decreasing energy loss and improving heat efficiency. The system includes an emptiness detecting switch which is adapted to detect start of emptying of water out of a water boiler being heated to a radiator. The switch is operatively connected directly or indirectly to an on-off valve so that the valve may be opened to flow water from an open tank to the water boiler when the switch detects start of the emptying.

14 Claims, 7 Drawing Sheets

HOT WATER CIRCULATING SYSTEM

BACKGROUND OF THE INVENTION

1. Field of the Invention

This invention relates to a hot water circulating system, and more particularly to a hot water circulating system for, for example, space heating which is adapted to supply hot water heated by a burner to a radiator by means of steam pressure without using a circulation pump.

2. Description of the Prior Art

A hot water circulating system which is adapted to carry out circulation of hot water heated in a water boiler to a radiator by means of not a circulation pump but steam pressure is conventionally proposed, as disclosed in Japanese Utility Model Publication No. 53929/1982, disclosure of which is incorporated herein by reference.

Such a conventional hot water circulating system is constructed in such a manner that steam pressure generated from a water boiler heated by a burner causes hot water in the water boiler to be forcibly fed to a radiator and then through a circulating pipe connected between the radiator and an open tank arranged at a position above the water boiler to the open tank, and water stored in the open tank is returned through an on-off valve or check valve to the water boiler. A structure for returning water to the water boiler utilizes a solenoid valve as the check valve, and the solenoid valve is operated by a signal generated from a level detector.

Another conventional hot water circulating system is disclosed in Japanese Patent Application No. 97966/1980, of which disclosure is incorporated herein by reference. The system is so constructed that an open pipe is arranged to communicate a water boiler and an upper space in an open tank and provided with a pressure release valve which is actuated by a signal generated from a level detector. A circulating pipe for connecting a radiator to the open tank is communicated directly to the upper space of the open tank.

As described above, in each of the conventional hot water circulating systems described above, returning of water stored in the open tank to the water boiler is carried out utilizing a signal generated from the level detector. This causes the returning to start while a significant amount of hot water still remains in the water boiler, resulting in a ratio of the amount of hot water supplied to the radiator to a volume of the water boiler in each hot water circulating cycle being decreased. Also, the conventional system exhibits another disadvantage that steam pressure in the water boiler escapes to the open tank to cause much energy loss when water stored in the open tank is returned to the water boiler.

Further, in the conventional system, the circulating pipe is arranged between the radiator and the open tank so as to directly connect both and the open tank is required to serve also as a storage tank, so that heat loss is further increased. In view of this respect, the conventional system is adapted to use heat contained in exhaust gas for preheating water. Nevertheless, water cooled in the radiator is substantially heated in only the water boiler.

In addition, in the conventional system, an increase in a temperature of water returned to the open tank due to, for example, an increase in a temperature in a room in which the radiator is placed causes an increase in the amount of water evaporated from the open tank, so that replenishment of circulated water is frequently required.

Accordingly, it would be highly desirable to develop a hot water circulating system which is capable of increasing the amount of hot water to be circulated in each circulating cycle, decreasing energy loss and decreasing loss of water by evaporation.

SUMMARY OF THE INVENTION

The present invention has been made in view of the foregoing disadvantages of the prior art.

Accordingly, it is an object of the present invention to provide a hot water circulating system which is capable of significantly increasing the amount of water to be circulated in each circulating cycle.

It is another object of the present invention to provide a hot water circulating system which is capable of substantially decreasing energy loss.

It is a further object of the present invention to provide a hot water circulating system which is capable of ensuring smooth supply of water to be heated.

It is still another object of the present invention to provide a hot water circulating system which is capable of significantly improving heat efficiency.

It is yet another object of the present invention to provide a hot water circulating system which is capable of preventing loss of water by evaporation.

It is still a further object of the present invention to provide a hot water circulating system which is capable of accomplishing the above-described objects with a simple structure.

In accordance with the present invention, a hot water circulating system is provided. The system includes an open tank, a water boiler arranged below the open tank, a radiator to which hot water is supplied from the water boiler, a circulating pipe system for communicating the open tank, water boiler and radiator with one another in turn. The circulating pipe system includes a first circulating pipe for communicating the open tank and water boiler with each other, a second circulating pipe for communicating the water boiler and radiator with each other and a third circulating pipe for communicating the radiator and open tank with each other. The system also includes an on-off valve arranged at the first circulating pipe, so that closing of the on-off valve may cause hot water in the water boiler to be forcibly supplied through the radiator to the open tank and opening of the on-off valve may cause water in the open tank to flow into the water boiler, resulting in repeating of operation of said on-off valve leading to continuous circulation of water through the system.

One of features of the present invention is in that emptiness detecting means is provided for detecting start of emptying of water out of the water boiler being heated. The emptiness detecting means is arranged at or near the water boiler and operatively connected directly or indirectly to the on-off valve so that the on-off valve may be opened when the emptiness detecting means detects start of emptying of water out of the water boiler being heated.

In a preferred embodiment of the present invention, the emptiness detecting means comprises an emptiness detecting switch. The switch may be a temperature switch or pressure switch.

BRIEF DESCRIPTION OF THE DRAWINGS

These and other objects and many of the attendant advantages of the invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a hot water circulating system according to the present invention will be described hereinafter with reference to the accompanying drawings.

Figure 1:
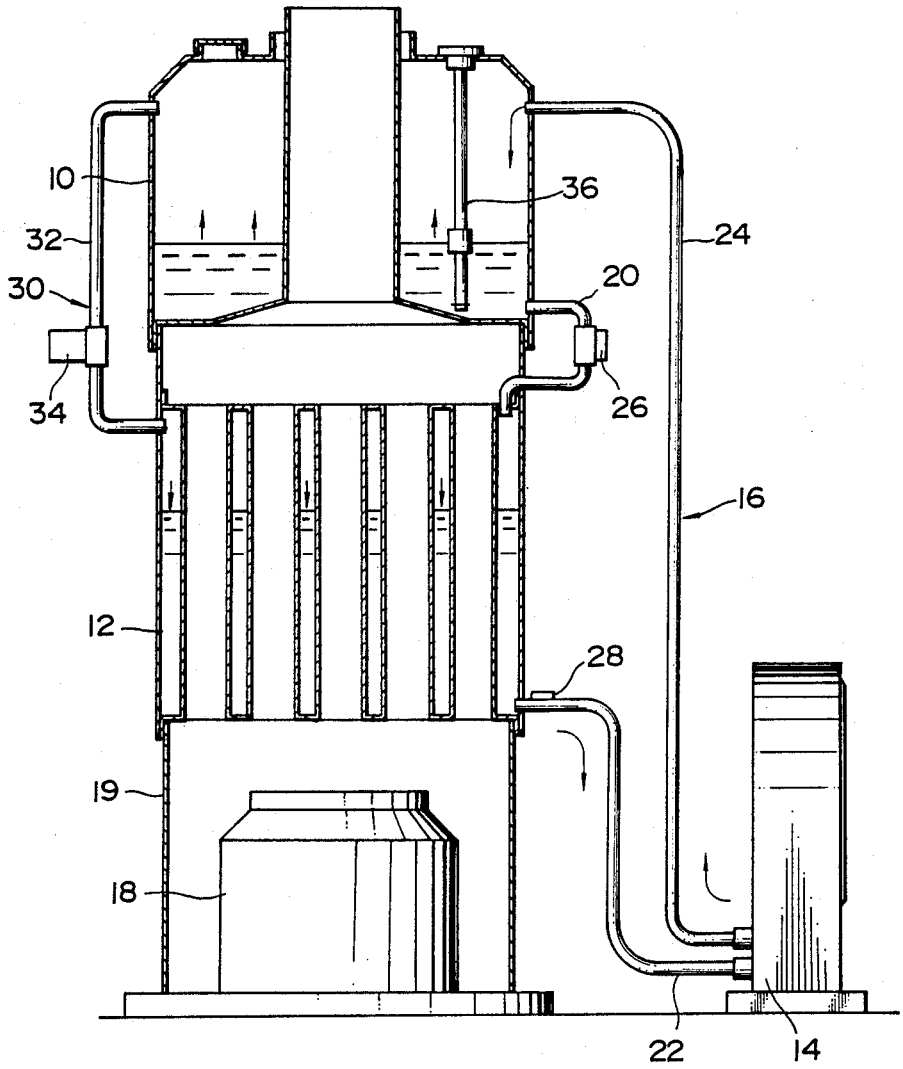
FIG. 1 is a vertical sectional view showing an embodiment of a hot water circulating system according to the present invention.

FIG. 1 illustrates an embodiment of a hot water circulating system according to the present invention.

A system of the illustrated embodiment generally includes an open tank 10, a water boiler 12 arranged at a position below the open tank 10, a radiator 14 to which hot water obtained in the water boiler 12 is supplied, and a circulating pipe system 16 for communicating the open tank 10, water boiler 12 and radiator 14 with one another in turn to circulate water through the system. The water boiler 12 is heated by suitable heating means 18 such as a burner. The burner 18 is received in a housing 19, on which the water boiler 12 is put. The circulating pipe system 16 includes a first circulating pipe 20 for communicating the open tank 10 and the water boiler 12 with each other, a second circulating pipe 22 for accomplishing communication between the water boiler 12 and the radiator 14, and a third circulating pipe 24 for communicating the radiator 14 with the open tank 10.

The first circulating pipe 20 is provided with an on-off valve 26. The on-off valve 26 may comprise a suitable valve such as a pressure valve, a combination of a pressure switch and a solenoid valve, or the like, although it is not limited to such valves.

General operation of the circulating system will be briefly described.

When the on-off valve 26 is closed and the water boiler 12 is heated by the burner 18, water vapor or steam generated from hot water obtained in the water boiler 12 applies its pressure on a surface of hot water in the water boiler 12 to cause hot water from the water boiler 12 to be forcibly fed to the radiator 14. The radiator 14 cools hot water supplied thereto, which is then returned to the open tank 10. Then, when the on-off valve 26 is opened, pressure in the water boiler 12 is released and water is fed from the the open tank 10 to the water boiler 12. Thus, a cycle of circulation of water is repeated by repeating operation of the on-off valve 26.

The system of the illustrated embodiment includes emptiness detecting means 28 which is adapted to detect start of emptying of water out of the water boiler 12 being heated by the burner 18 into the radiator 14. The emptiness detecting means 28 may be arranged at or separate from the water boiler 12. The means 28 may comprise a switch. In the illustrated embodiment, the emptiness detecting switch 28 comprises a temperature switch arranged on the circulating pipe 22 connected between the water boiler 12 and the radiator 14 to detect a temperature of fluid flowing through pipe 22, to thereby detect start of emptying of water out of the water boiler 12 being heated. The switch detects a variation of a temperature of water which occurs when it changes from liquid to vapor. A liquid temperature of water substantially free of chemicals is normally about 100° C. or below, whereas its vapor temperature is normally above 100° C. When the emptying starts, the space in the water boiler and the pipe 22 are substantially occupied by only water vapor or steam because the water boiler is emptied.

Figure 2:
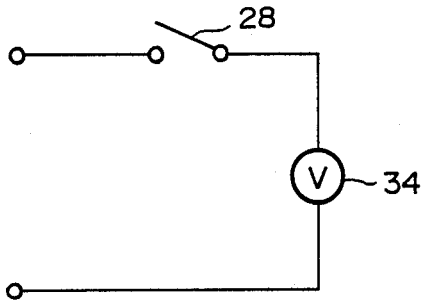
FIG. 2 is a circuit diagram showing electrical connection between an emptiness detecting switch and a pressure release valve in the embodiment of FIG. 1.

The illustrated embodiment may include a pressure release means 30, which, in the illustrated embodiment, comprises a pressure release pipe 32 for communicating an upper space in the open tank 10 with an upper portion or space of the water boiler 12 and a pressure release valve 34 arranged at the pressure release pipe 32. The pressure release means 30 comprising the pipe 32 and valve 34 serves to actuate or open the on-off valve 26 to ensure smooth supply of water from the open tank 10 through the pipe 20 to the water boiler 12 when the temperature switch 28 detects start of the emptying. For this purpose, the pressure release valve 34 may be operatively connected to the emptiness detecting means or temperature switch 28 as shown in FIG. 2. More particularly, when the emptiness detecting switch 28 detects start of the emptying and generates a signal which is supplied to the pressure release valve 34 through the circuit of FIG. 2, the valve 34 is opened to release pressure in the water boiler 12 through the pressure release pipe 32 to the open tank 10 in the case that pressure in the boiler 12 is above atmospheric pressure, so that pressure in the boiler 12 may be equal to that in the upper space of the tank 10. This causes pressure due to head of water in the open tank 10 to open the on-off valve 26, resulting in water flowing from the tank 10 to the boiler 12.

Figure 3:
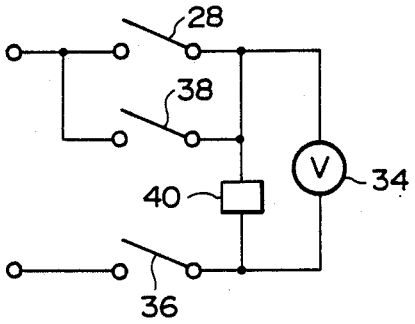
FIG. 3 is a circuit diagram showing electrical connection of an emptiness detecting switch and a level detector to a pressure release valve in the embodiment of FIG. 1.

The hot water circulating system of the illustrated embodiment may also include a level detector 36 such as a float switch or the like. The level detector 36 is provided for the purpose of detecting lowering of a surface of water in the open tank 10 to a predetermined level to close the pressure release valve 34. For this purpose, the level detector 36 may be connected to the pressure release valve 34 in such a manner as shown in FIG. 3, wherein reference numerals 38 and 40 indicate a relay contact and a relay, respectively.

Now, the manner of operation of the system of the the illustrated embodiment will be described.

First, the on-off valve 26 and pressure release valve 34 are opened. Then, water is supplied to the open tank 10. This results in water flowing through the pipe 20 and valve 26 to the water boiler 12, radiator 14 and circulating pipe system 16. Supply of water to the tank 10 is stopped when water is stored in a small amount therein.

Subsequently, the pressure release valve 34 or both the on-off valve 26 and pressure release valve 34 are closed. When the on-off valve is not closed, it is automatically closed with an increase in pressure in the water boiler. Then, the burner 18 is ignited to heat the water boiler 12. This results in water in the boiler being heated to generate water vapor or steam therefrom, which applies its pressure on a surface of hot water in the water boiler 12 to cause it to be forcibly fed to the radiator 14. The radiator cools the hot water, which is then returned to the open tank 10.

When emptying of hot water out of the water boiler 12 being heated into the open tank 10 through the radiator 14 starts due to forcible supply of substantially all hot water from the boiler 12 to the tank 10, the emptiness detecting switch 28 actuates to open the pressure release valve 34 to cause pressure in the boiler 12 to be forcibly equal to that in the open tank 10. This results in pressure of head of water stored in the tank 10 opening the on-off valve to cause it to flow from the tank through the pipe 20 to the water boiler 12. At this time, when the water boiler is at an overheated state, the water is instantaneously vaporized in the boiler to increase pressure therein. However, the opened valve 34 escapes excessive pressure in the boiler 12 through the pipe 32 to the upper space of the open tank 10, resulting in the on-off valve 26 being kept open.

When a surface of water in the open tank 10 is lowered to a predetermined level and the lowering is detected by the level detector 36, it actuates to close the pressure release valve 34. Thus, the circulating cycle is repeatedly carried out. The on-off valve 26 is automatically closed when pressure in the water boiler 12 is increased due to heating of the boiler 12 by the burner 18. However, a timer may be used to close the opened valve 26 in a predetermined time after it is opened, as in the prior art.

Arrangement of the pressure release means 30 in the illustrated embodiment is particularly effective to prevent an increase in the pressure which occurs when air is present in the form of a mixture with water vapor in the space in the boiler, because the presence of air decreases condensation of water vapor.

As described above, in the illustrated embodiment, emptiness detection is carried out by detecting an increase in a temperature of the circulating pipe 22 other than detecting an increase in a temperature of a bottom of the boiler 12. When the boiler approaches an emptied state, hot water is fed together with water vapor or steam from the boiler 12 to the circulating pipe 22. However, when the boiler starts to be emptied, only steam is fed to the pipe. The pipe 22 is held at a liquid temperature while hot water is being fed thereto, whereas its temperature is increased to a vapor temperature when only steam starts to be fed thereto. Accordingly, detection of emptiness of the boiler may be effectively accomplished by detecting a temperature of the circulating pipe 22.

As can be seen from the foregoing, in the hot water circulating system shown in FIG. 1, the emptiness detecting switch is used to detect start of emptying of water out of the water boiler being heated into the radiator, so that substantially all hot water in the boiler may be fed to the radiator, resulting in the amount of water effectively circulated in each circulating cycle being significantly increased.

Also, in the illustrated embodiment, pressure in the water boiler 12 just before start of the emptying actually approaches to atmospheric pressure, accordingly, pressure of steam escaping to the open tank 10 by opening the on-off valve 26 or pressure release valve 34 may be substantially decreased as compared with the prior art, resulting in energy loss being highly decreased.

Figure 4:
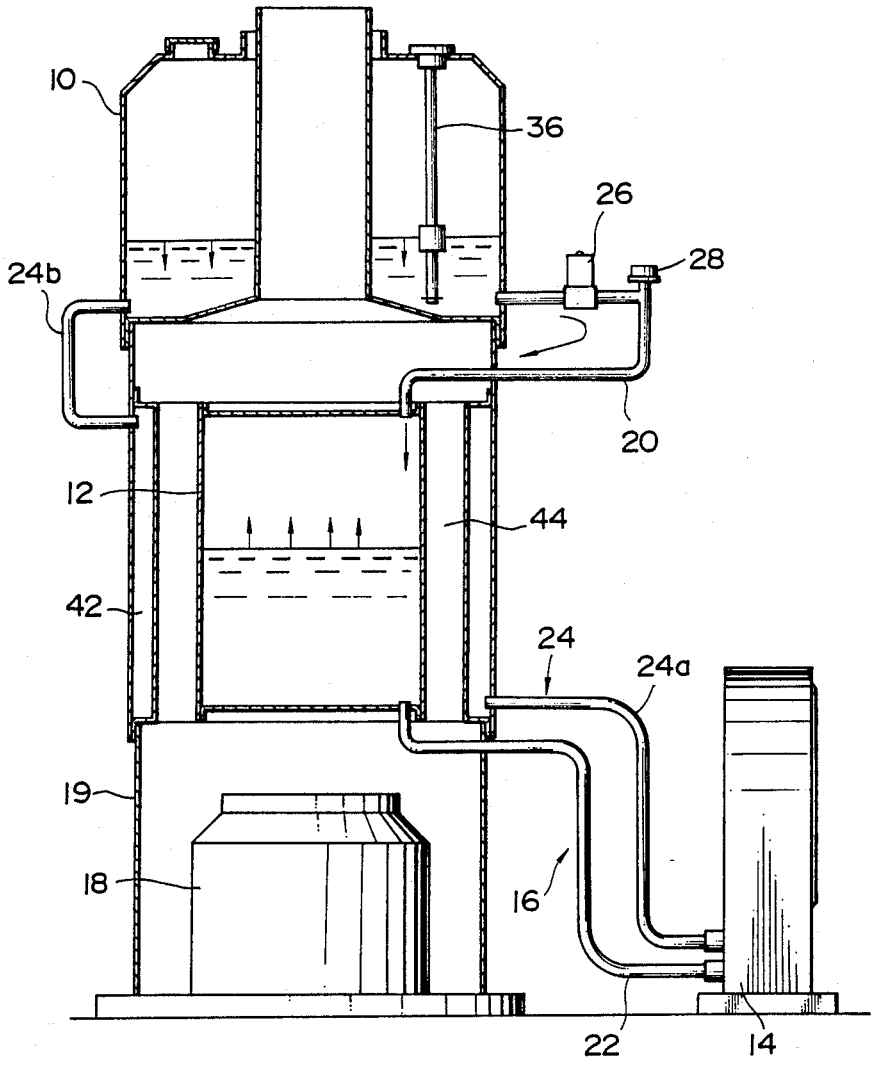
FIG. 4 is a vertical sectional view showing another embodiment of a hot water circulating system according to the present invention.

FIG. 4 shows another embodiment of a hot water circulating system according to the present invention.

A system of FIG. 4 is so constructed that water starts to be supplied from an open tank to a water boiler just when emptying of water out of the boiler being heated to a radiator starts.

In the embodiment shown in FIG. 1, the temperature switch 28 is adapted to detect a variation of a temperature of water due to change from its liquid state to its vapor state to detect start of emptying of water out of the boiler 12 into the radiator. Accordingly, it fails to detect emptying of water out of the boiler into the radiator unless the emptying starts. This leads to a fear that the water boiler is overheated to cause water introduced from the open tank to the boiler to fail to cool the boiler, so that a large amount of water vapor or steam is generated in the boiler, which highly increases pressure in the boiler to a degree sufficient to close the on-off valve 26 to prevent flowing of water into the boiler. The pressure release means are provided in order to avoid such a problem.

The embodiment of FIG. 4 is so constructed that the above-noted problem may be effectively prevented without such pressure release means as used in the embodiment described above.

For this purpose, a system of the embodiment uses, as emptiness detecting means 28, a pressure switch for detecting pressure in a water boiler 12. A pressure switch is generally adapted to continuously detect a variation in pressure. Use of a pressure switch as the emptiness detecting means 28 causes pressure in the water boiler 12 prior to start of emptying of water out of the boiler being heated into a radiator 14 to be effectively distinguished from that at the time of start of the emptying, resulting in an on-off valve being opened at any desired time prior to the emptying to cause water to reach the boiler just when the emptying starts. Accordingly, any means such as the pressure release means 30 used in the above-described embodiment may be effectively eliminated from the modification. Thus, it will be noted that the pressure switch may be actuated to detect a variation of pressure in the water boiler from positive pressure to substantially atmospheric pressure.

Figure 5:
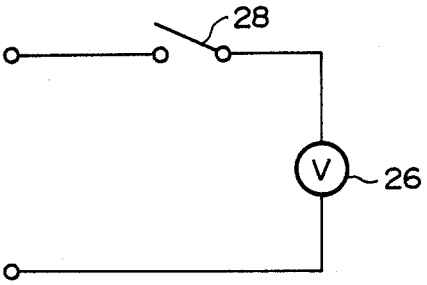
FIG. 5 is a circuit diagram showing electrical connection between an emptiness detecting switch and an on-off valve in the embodiment of FIG. 4.

The pressure switch 28 may be arranged at the water boiler 12 or separate therefrom so long as it may effectively detect pressure in the boiler 12. In the modification, it is arranged at a portion of a first circulating pipe 20 between an on-off valve 26 and the water boiler 12. Also, in the modification, the on-off valve 26 may be operatively connected directly to the pressure switch 28 in such a manner as shown in FIG. 5.

Also, the embodiment may include a lower tank 42 communicated with the open tank 10 and arranged so as to surround the water boiler 12 and be directly heated by a burner 18. In the embodiment, the lower tank 42 is arranged separate from the open tank 10, and a third circulating pipe 24 connected between the radiator 14 and the open tank 10 is divided into two portions 24*a* and 24*b* between which the lower tank 42 is arranged. The circulating pipe 24 is so provided that a portion thereof connected to the open tank 10 is opened to water in the open tank 10. Also, the lower tank 42 is arranged in a manner to surround the water boiler 12 through an exhaust gas passage 44 defined therebetween.

The remaining of the embodiment may be constructed substantially the same manner as the above-described embodiment of FIG. 1.

Thus, it will be noted that the embodiment shown in FIG. 4 eliminates a fear that the water boiler is overheated to cause water introduced from the open tank to the boiler to fail to cool the boiler, so that a large amount of water vapor or steam is generated in the boiler, which highly increases pressure in the boiler to a degree sufficient to close the on-off valve to prevent flowing of water into the boiler, without using any means such as the pressure release means 30 in the embodiment of FIG. 1.

Also, in the embodiment of FIG. 4, the lower tank 42 communicated with the radiator 14 and open tank 10 is arranged so as to surround the water boiler 12 and directly heated by the burner 18, so that water cooled in the radiator 14 is heated to hot water in the lower tank 42 on the way to the open tank 10. The water is then supplied through the pipe 24*b* to the open tank 10 while being kept at a high temperature. Accordingly, water supplied from the open tank 10 to the water boiler 12 through the pipe 20 by opening the on-off valve 26 is kept at a high temperature, resulting in supply of hot water from the water boiler 12 to the radiator 14 being rapidly started to highly improve heat efficiency.

Thus, it will be noted that in the embodiment of FIG. 4, the water boiler 12 mainly functions as pumping means, and the open tank 10 functions as both conventional open tank and water boiler in cooperation with the lower tank. More particularly, heat energy supplied from the burner 18 to the water boiler 12 is mainly used for water pumping action of forcibly feeding water supplied from the open tank 10 to the radiator 14, because the water boiler 12 is surrounded by the lower tank 42 to substantially increase heat efficiency of the system. Thus, the embodiment significantly decreases a time required for each water circulating cycle to increase heating efficiency.

Figure 6:
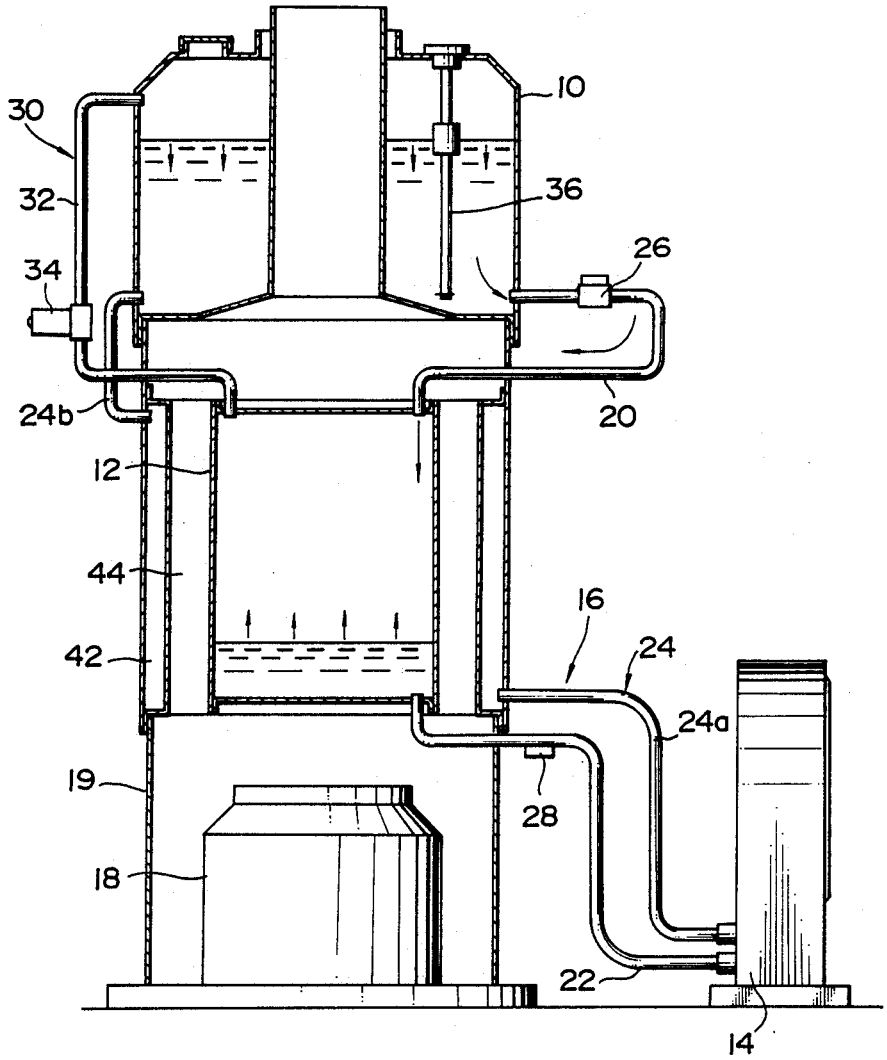
FIG. 6 is a vertical sectional view showing a modification of the embodiment shown in FIG. 4.

FIG. 6 shows a modification of the embodiment shown in FIG. 4, wherein a temperature switch is substituted for the pressure switch 28 in the embodiment of FIG. 4 and pressure release means 30 is provided between a water boiler 12 and a open tank 10 as in the embodiment shown in FIG. 1. The temperature switch 28 is arranged at a second circulating pipe 22 as in the embodiment of FIG. 1. The remaining of the modification of FIG. 6 may be constructed in substantially the same manner as in FIG. 4.

Thus, it will be noted that the modification of FIG. 6 accomplishes the same advantages as those of the embodiment of FIG. 4.

Figure 7:
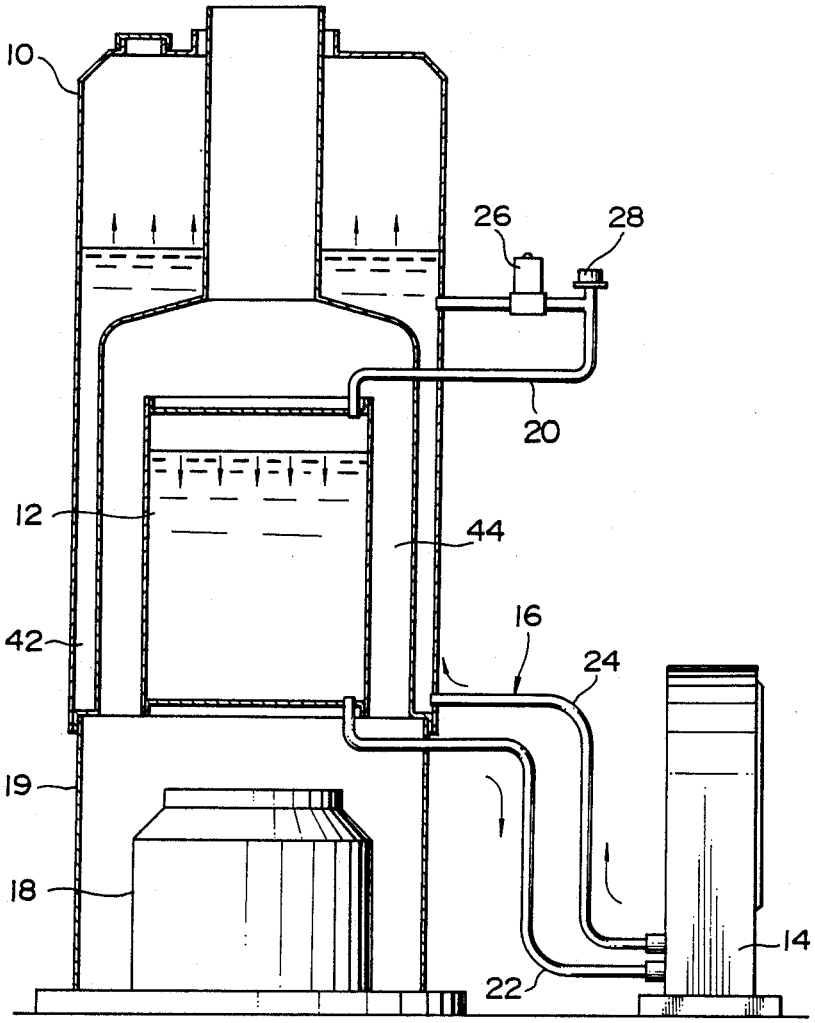
FIG. 7 is a vertical sectional view showing another modification of the embodiment shown in FIG. 4.

FIG. 7 shows another modification of the embodiment shown in FIG. 4. In the modification, a lower tank 42 is formed integral with an open tank 10. More particularly, the lower tank 42 is formed by downwardly extending an outer wall and a circumference of a bottom wall of the open tank 10 so that it may surround a water boiler 12 through an annular exhaust gas passage 44. Accordingly, in the modification, a third circulating pipe 24 is provided only for the purpose of communicating a radiator 14 with the lower tank 42 or open tank 10. In FIG. 7, although a level detector such as the detector 36 in FIG. 4 is not provided, it may be arranged in the open tank 10 in the modification. The remaining of the modification may be constructed in substantially the same manner as the embodiment of FIG. 4.

Thus, it will be readily noted that the modification of FIG. 7 exhibits substantially the same advantages as the embodiment of FIG. 4.

Figure 8:
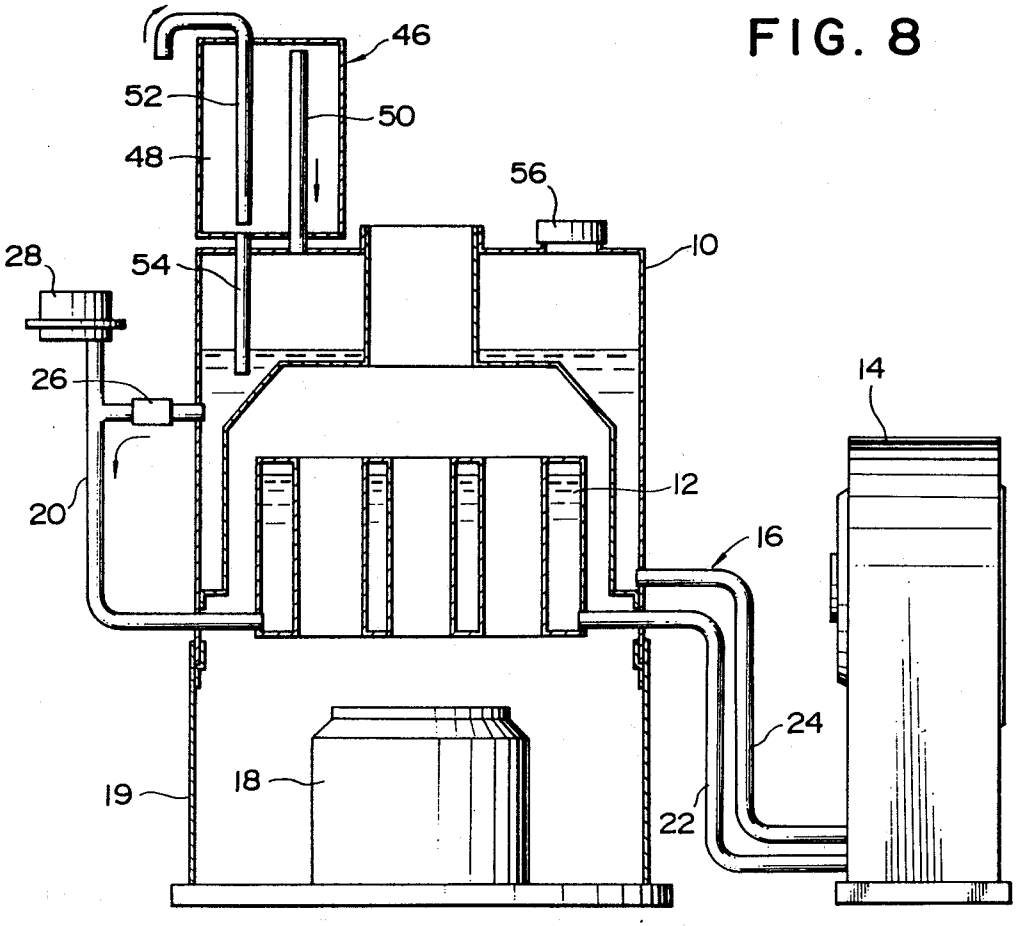
FIGS. 8 and 9 each are a vertical sectional view showing a further embodiment of a hot water circulating system according to the present invention.
Figure 9:
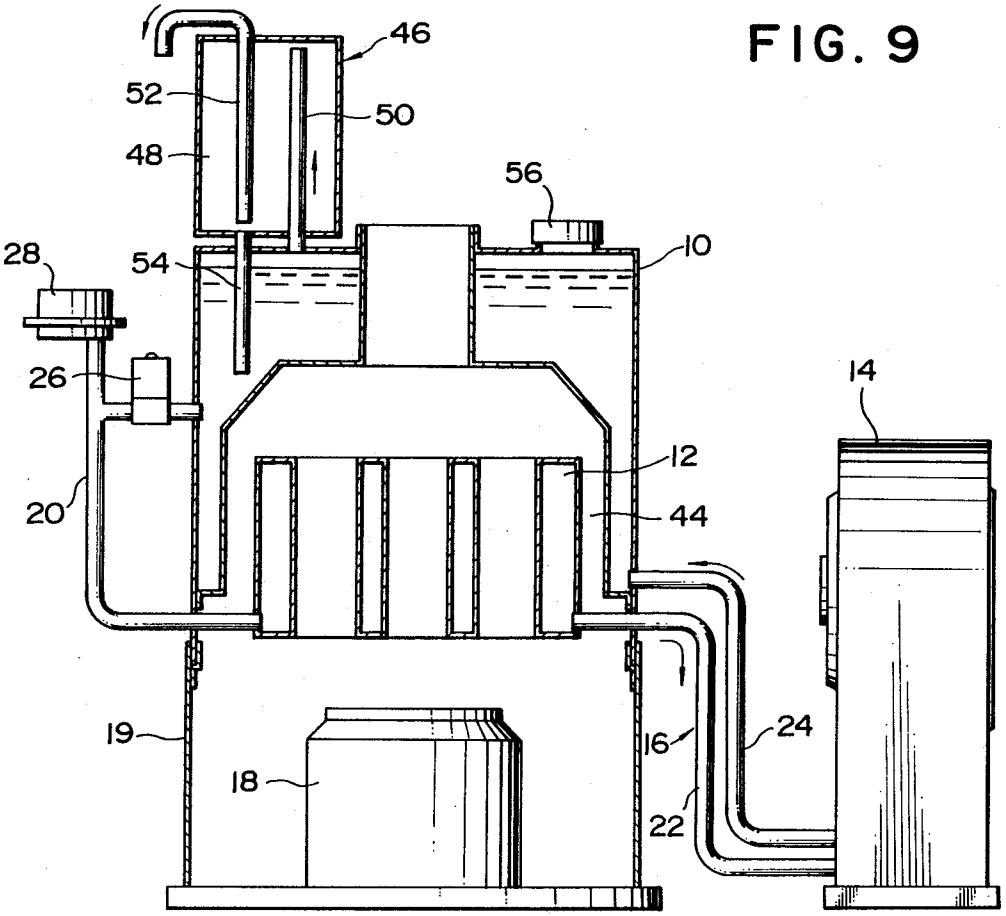

FIGS. 8 and 9 show a further embodiment of a hot water circulating system according to the present invention. A system of the illustrated embodiment is adapted to decrease loss of water by evaporation as well as accomplish the advantages exhibited by the embodiments described above.

A system of the embodiment includes a steam recovery structure generally designated at reference numeral 46 arranged above and communicated with an open tank 10. The steam recovery structure 46 includes a steam recovery tank 48 arranged above an open tank 10 and a communication pipe 50 vertically arranged in the tank 48. The pipe 50 is opened at an upper end thereof to an upper portion of a space in the tank 48 and communicated at a lower end thereof with the open tank 10. In the embodiment, the lower end of the pipe 50 is connected to an upper wall of the open tank 10. Also, the structure 46 includes an open pipe 52 which has one end communicated with an ambient atmosphere and the other end positioned at a lower portion of the space in the recovery tank 48 and a recovery pipe 54 which is connected at one end or an upper end thereof to a lowermost portion of the recovery tank 48 and positioned at the other end or a lower end thereof in the open tank 10. In the illustrated embodiment, the recovery pipe 54 is constantly dipped at its lower end in water in the open tank 10. Reference numeral 56 designates a cap, which is removed when supply of water to the system is to be carried out.

The remaining of the embodiment of FIGS. 8 and 9 may be constructed in substantially the same manner as the system shown in FIG. 7. However, a circulating pipe 20 for communicating the open tank 10 with a water boiler 12 is connected at a lower end thereof to a lower portion of the boiler 12.

In the embodiment constructed of FIGS. 8 and 9 as described above, when water in the open tank 10 is supplied to a water boiler 12, a level of water in the open tank 10 is lowered as shown in FIG. 8; whereas when it is returned from the water boiler 12 through a radiator 14 to the open tank 10, it rises as shown in FIG. 9. This causes access of air between the open tank 10 and the steam recovery tank 48 to be continuously carried out through the communication pipe 50 communicated, resulting in a possibility that water in the open tank 10 is lost in the form of water vapor.

However, in the embodiment, the communication pipe 50 is opened at its upper end to the upper space of the vapor recovery tank 48 and the tank 48 is communicated through the open pipe 52 opened to the lower portion of the tank 48 to an ambient atmosphere, so that when a level of water in the open tank 10 is lowered, cool air is suckedly supplied from an ambient atmosphere through the pipe 52 to the lower portion of the steam recovery tank 48. This causes hot air in the upper space of the tank 48 to be sucked into the open tank 10. Then, when the level gradually rises, steam-containing air supplied from the open tank 10 through the communication pipe 50 to the upper space of the steam recovery tank 48 remains in the upper space because it is hot and substitutionally air of a low temperature in the lower space of the tank 48 is gradually discharged through the open pipe 52 to an exterior of the system, during which the vapor-containing hot air in the upper space of the tank 48 contacts with the cool air to decrease its volume, so that the hot air may be prevented from being discharged through the open pipe 52 to the exterior. Water recovered in the steam recovery tank 48 by condensation of water vapor contained in the hot air due to a decrease in its temperature is returned through the recovery pipe 54 to the open tank 10.

As can be seen from the foregoing, the embodiment of FIGS. 8 and 9 is so constructed that steam-containing hot air in the open tank 10 is discharged to not an ambient atmosphere but the steam recovery tank 48, which is then suckedly returned to the open tank 10. Accordingly, it effectively prevents steam from being substantially discharged to the exterior.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A hot water circulating system comprising:

an open tank;

a water boiler arranged below said open tank;

a radiator to which hot water is supplied from said water boiler;

a circulating pipe system comprising a first circulating pipe means for communicating said open tank and water boiler with each other, a second circulating pipe means for communicating said water boiler and radiator with each other and a third circulating pipe means for communicating said radiator and open tank with each other;

an on-off valve arranged at said first circulating pipe means, closing of said on-off valve causing said hot water in said water boiler to be forcibly supplied through said radiator to said open tank and opening of said on-off valve causing water in said open tank to flow into said water boiler so that repeating of operation of said on-off valve may result in water being continuously circulated through said system; and, emptiness detecting means for detecting when said water boiler is substantially occupied by only water vapor because said water boiler starts to be empty of liquid water while being heated, said emptiness detecting means being arranged at or near said water boiler;

said emptiness detecting means being operatively connected to said on-off valve so that said on-off valve may be opened when said emptiness detecting means detects said start of emptying due to the forcible supply of substantially all hot liquid water out of said water boiler being heated.

2. A hot water circulating system as defined in claim 1, wherein said emptiness detecting means comprises a temperature switch which detects a variation of a temperature of water from its liquid temperature to its vapor temperature.

3. A hot water circulating system as defined in claim 2 further comprising pressure release means which is operatively connected to said temperature switch so that it may be actuated to release pressure in said water boiler to open said on-off valve when said temperature switch detects start of said emptying.

4. A hot water circulating system as defined in claim 3, wherein said pressure release means comprises a pressure release pipe connected between said water boiler and said open tank and a pressure release valve arranged at said pressure release pipe, said pressure release valve being connected to said temperature switch.

5. A hot water circulating system as defined in claim 1, wherein said emptiness detecting means comprises a pressure switch which detects a variation of pressure in said water boiler from positive pressure to substantially atmospheric pressure.

6. A hot water circulating system as defined in claim 1 further comprising a lower tank arranged around said water boiler so as to surround said water boiler and communicated with said open tank and radiator through said second circulating pipe means.

7. A hot water circulating system as defined in claim 6, wherein said lower tank is formed integral with said open tank.

8. A hot water circulating system as defined in claim 1 further comprising a steam recovery structure.

9. A hot water circulating system as defined in claim 8, wherein said steam recovery structure comprises a steam recovery tank arranged above said open tank, a communication pipe for communicating an upper space of said open tank with an upper space of said steam recovery tank, an open pipe communicated at one end thereof to a lower space of said steam recovery tank and the other end thereof to an ambient atmosphere, and a recovery pipe connected at one end thereof to a lowermost position of said steam recovery tank and opened at the other end thereof to said open tank.

10. A hot water circulating system as defined in claim 9, wherein said the other end of said recovery pipe is constantly positioned in water in said open tank.

11. A hot water circulating system comprising:

an open tank;

a water boiler arranged below said open tank;

a radiator to which hot water is supplied from said water boiler;

a circulating pipe system comprising a first circulating pipe for communicating said open tank and water boiler with each other, a second circulating pipe for communicating said water boiler and radiator with each other and a third circulating pipe means for communicating said radiator and open tank with each other;

an on-off valve arranged at said first circulating pipe, closing of said on-off valve causing said hot water in said water boiler to be forcibly supplied through said radiator to said open tank and opening of said on-off valve causing water in said open tank to flow into said water boiler so that repeating of operation of said on-off valve may result in water being continuously circulated through said system;

emptiness detecting means for detecting start of emptying of water out of said water boiler when heated, said emptiness detecting means being arranged at or near said water boiler;

said emptiness detecting means being operatively connected to said on-off valve so that said on-off valve may be opened when said emptiness detecting means detects start of emptying of water out of said water boiler being heated; and, a lower tank arranged around said water boiler so as to surround said water boiler and communicated with said open tank and radiator through said third circulating pipe means.

12. A hot water circulating system comprising:

an open tank;

a water boiler arranged below said open tank;

a radiator to which hot water is supplied from said water boiler;

a circulating pipe system comprising a first circulating pipe for communicating said open tank and water boiler with each other, a second circulating pipe for communicating said water boiler and radiator with each other and a third circulating pipe for communicating said radiator and open tank with each other;

an on-off valve arranged at said first circulating pipe, closing of said on-off valve causing said hot water in said water boiler to be forcibly supplied through said radiator to said open tank and opening of said on-off valve causing water in said open tank to flow into said water boiler so that repeating of operation of said on-off valve may result in water being continuously circulated through said system;

emptiness detecting means for detecting start of emptying of water out of said water boiler when heated, said emptiness detecting means being arranged at or near said water boiler;

said emptiness detecting means being operatively connected to said on-off valve so that said on-off valve may be opened when said emptiness detecting means detects start of emptying of water out of said water boiler being heated; and, a steam recovery structure comprising a steam recovery tank arranged above said open tank, a communication pipe for communicating an upper space of said open tank with an upper space of said steam recovery tank, an open pipe communicated at one end thereof to a lower space of said steam recovery tank and at the other end thereof to an ambient atmosphere, and a recovery pipe connected at one end thereof to a lowermost position of said steam recovery tank and dipped at the other end thereof in water in said open tank.

13. A hot water circulating system as defined in claim 11, wherein said emptiness detecting means comprises means for detecting when said water boiler is substantially occupied by only water vapor because said water boiler starts to be empty of liquid water while being heated.

14. A hot water circulating system as defined in claim 12, wherein said emptiness detecting means comprises means for detecting when said water boiler is substantially occupied by only water vapor because said water boiler starts to be empty of liquid water while being heated.

* * * * *